United States Patent [19]

Bittman

[11] 3,949,543

[45] Apr. 13, 1976

[54] STRANDED WIRE FORMING METHOD AND APPARATUS

[75] Inventor: Jesse Clarence Bittman, Cuyahoga Falls, Ohio

[73] Assignee: Wean United, Inc., Pittsburgh, Pa.

[22] Filed: Nov. 15, 1974

[21] Appl. No.: 524,168

[52] U.S. Cl. ..... 57/34 R; 57/58.52; 57/160; 57/166

[51] Int. Cl.[2] ..... D07B 3/00

[58] Field of Search ..... 57/3, 6, 13, 14, 34 R, 57/58.3, 58.32, 58.34, 58.36, 58.38, 58.49, 58.52, 58.54, 58.55, 58.57, 58.65, 58.7, 58.72, 58.79, 59, 106, 113, 156, 166, 160

[56] References Cited

UNITED STATES PATENTS

| | | | |
|---|---|---|---|
| 477,784 | 6/1892 | Sisum | 57/58.32 |
| 592,453 | 10/1897 | Sisum | 57/58.32 |
| 1,972,290 | 9/1934 | Conner | 57/58.32 X |
| 2,464,860 | 3/1949 | Green | 57/58.78 X |
| 3,431,718 | 3/1969 | Hofrichter | 57/59 |
| 3,791,127 | 2/1974 | Wesson | 57/58.52 |
| 3,791,131 | 2/1974 | Scott et al. | 57/166 X |
| 3,824,775 | 7/1974 | Birsch | 57/58.52 |
| 3,867,809 | 2/1975 | Holbrook | 57/58.52 |

*Primary Examiner*—Donald E. Watkins
*Attorney, Agent, or Firm*—Daniel Patch; Henry C. Westin

[57] ABSTRACT

The present disclosure relates to a method and a machine for forming stranded wire into a wire cord and comprises the steps and elements of mounting several spools of individual wire strands on a common arbor in a manner that the strands may be unwound in the same direction and fed to a gathering sheave, rotating means for supporting two spaced-apart flyer sheaves arranged radially upward of said gathering sheave, said flyer sheaves being arranged so that the several strands are fed radially outward from said gathering sheave and, hence, from one flyer sheave to the other and, thence, to a discharge station arranged coaxially with said gathering sheave and on the same side of a wire coiling means adapted to pull the wire through the machine, the construction and arrangement of elements being such that the individual strands of wire are caused to be formed into a wire cord in which the number of twists per unit length is a function of the speed of travel of the wire and the revolutions per minute of the rotating means.

14 Claims, 7 Drawing Figures

STRANDED WIRE FORMING METHOD AND APPARATUS

In the past indefinite lengths of wire cord or similar stranded wire products made up of two or more individual wire strands were formed by several different types of machines; one of which is known as a wire buncher. These machines and the method they employ to form the wire cord possess some very serious disadvantages and limitations that greatly limit their production capacity and efficiency. Because of the way the several individual spools of wire used to supply the machine were mounted and fed to the stranding device of the machine, it was not possible to assure that the individual strands of wire were subject to the same tension with respect to each other at a given point in time during their unwinding. Moreover, in such machines and methods it was not possible to assure that the tension would be held uniform from the commencing to the finishing of the unwinding with respect to the individual spools. In addition, past machines and methods employed thereby did not, in many cases, allow for quick and accurate setting and adjustment of the tension of the wire strands. In many ultimate uses of the wire cord, such as in its use in the manufacture of passenger vehicle tires, unequal tension in the wire strands of the cord cannot be tolerated because of the difficulty, for one thing, of assuring that the sheared lengths of wire cord will be properly positioned during the calendering process.

Prior machines for forming wire cord also possess the serious limitation of only being able to handle relatively small quantities of wire strands which necessitataed frequent interruption of the operation of the machine in order to resupply the machines with new spools. One of the reasons that prior machines were so limited in capacity was by reason of their inherent design features which developed very high and objectionable centrifugal forces and bearing loads. Another reason for prior machines not being capable of meeting high production efficiency is their failure to provide a proper means to control the torsional forces on the spools as the spools decreased in diameter and to provide such a means that would be capable of long, uninterrupted dependable operation. In addition prior machines were not capable of providing a flyer sheave construction that would sustain the necessary life and lend itself to quick removing and replacing of the flyer sheaves.

The present invention has for its object to provide a machine and method for overcoming each and every one of the aforesaid limitations and disadvantages of prior methods and machines for forming wire cords and similar stranded articles of manufacture.

More particularly, it provides a means and method of forming wire cord and similar articles of manufacture and comprises the steps and elements of mounting several spools of individual wire strands on a common arbor in a manner that the strands may be unwound in the same direction and fed into a gathering means, rotating means for supporting two spaced-apart flyer means arranged radially upward of said gathering means, said flyer means being arranged so that several strands are fed radially outward from said gathering means to one of the flyer means and, hence, to the other flyer means and, thence, to a discharge station arranged coaxially with said gathering means and on the same side of a wire coiling means adapted to pull the wire through the machine at a given rate of speed; the construction and arrangement of the elements being such that the individual strands of wire are caused to be formed into a wire cord in which the number of twists per unit length thereof is a function of said speed of travel of the wire and the revolutions per minute of the rotating means.

A still further object of the present invention is to provide a method and means for mounting a number of spools of wire strands on a common axis thereby substantially decreasing the centrifugal forces involved in feeding the strands to the cord forming elements thereof.

Another object is to provide an automatic tension compensating device, including a means for engaging the outer periphery of one of the spools and means for adjusting the torque of all spools as a function of the decrease in the diameters of the strands of wire of the spools as the strands are unwound.

Lastly, another object of the invention is to provide an improved means and method of mounting the flyer sheaves in a manner that they will assure increased productivity and allow for quick changing.

These objects, as well as other novel features and advantages of the present invention, will be better understood when the following description of one embodiment is read along with the accompanying drawings of which:

Figure 1:
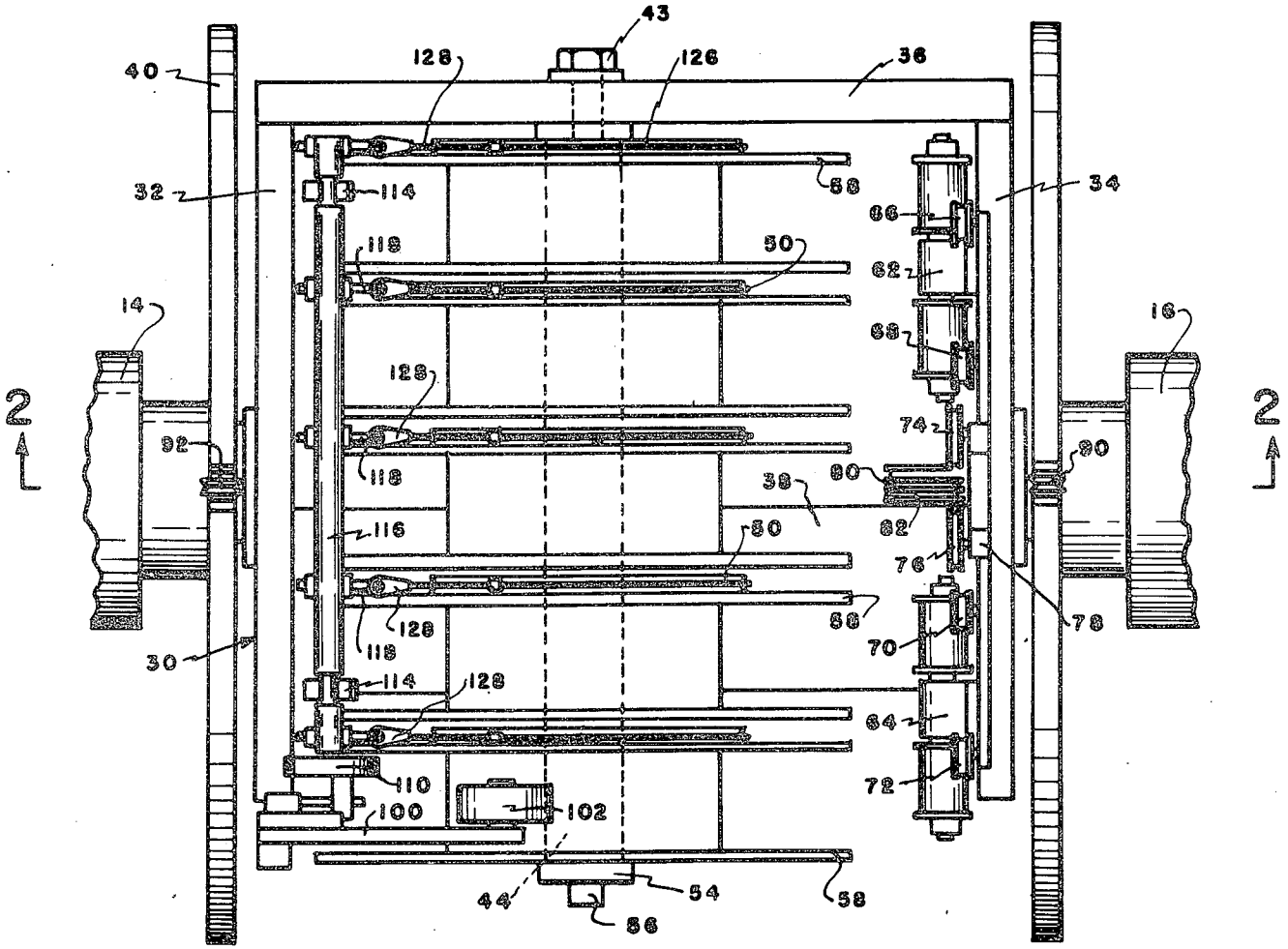
FIG. 1 is a plan view of a wire forming machine built in accordance with the present invention, certain elements being omitted for clarity.
Figure 2:
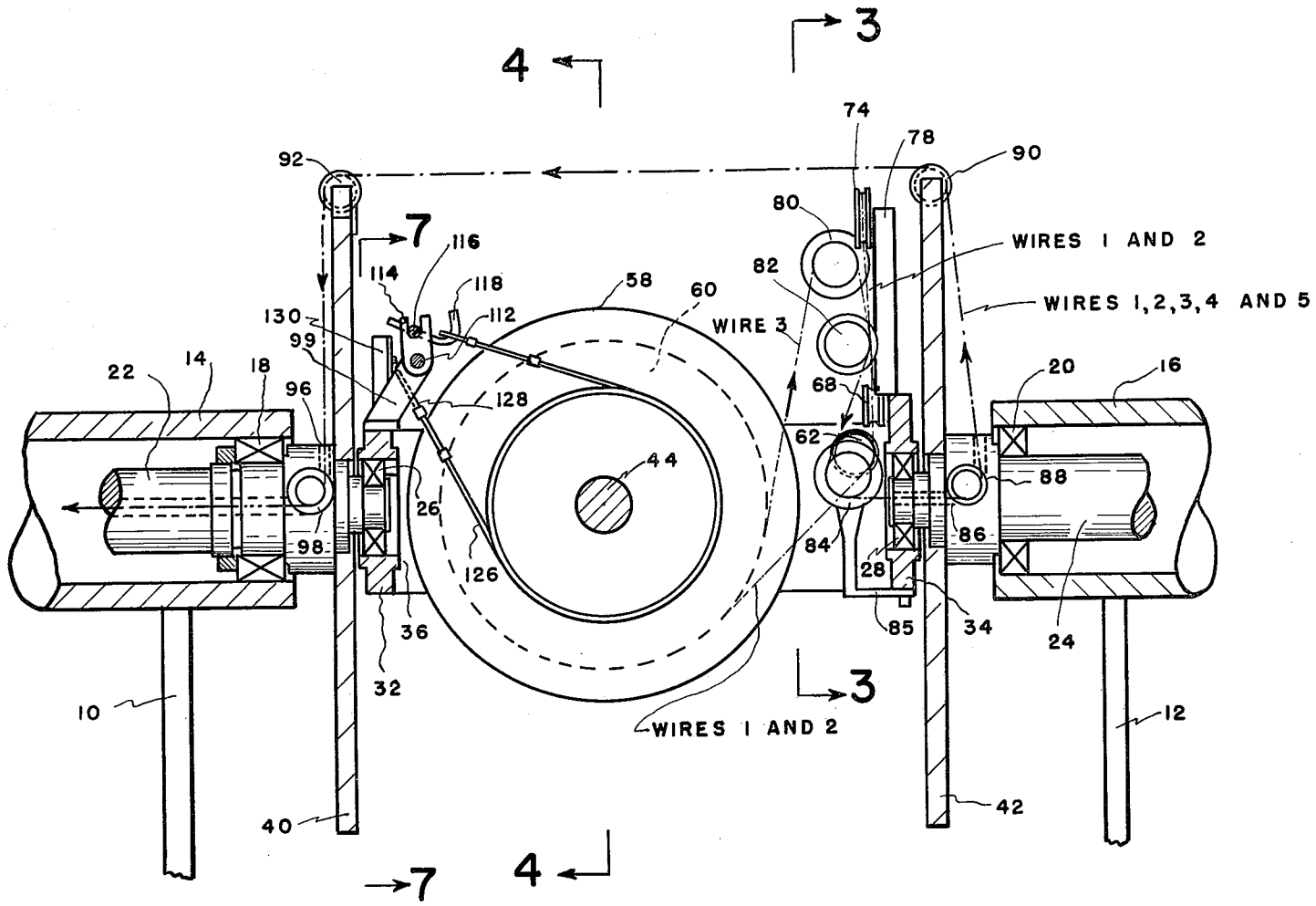
FIG. 2 is a sectional view taken on lines 2—2 of FIG. 1.

In referring first to FIGS. 1 and 2, the wire forming apparatus is made up of two opposed upright stands 10 and 12 each for supporting horizontally extending hollow tubular housings 14 and 16. Only the inner ends of the housings are illustrated which receive bearings 18 and 20 that support the inner ends of opposed internally driven shafts 22 and 24; the other ends of the shafts, although not shown, being similarly suported.

Additional bearings 26 and 28 are mounted on the extreme inner ends of the shafts 22 and 24 for supporting a frame 30. The frame takes the form of an opened top horizontally arranged rigid box having side members 32 and 34 and back and front members 36 and 38. While the frame 30 is free to rotate about the bearings 26 and 28, it essentially is a stationary member employed to support a spool shaft, a sheave system and a wire tension control system. Between the inner ends of the shafts 22 and 24 and their respective bearings 18 and 20, there are mounted for rotation with the shafts flying discs 40 and 42 more about which will be explained later.

Figure 4:
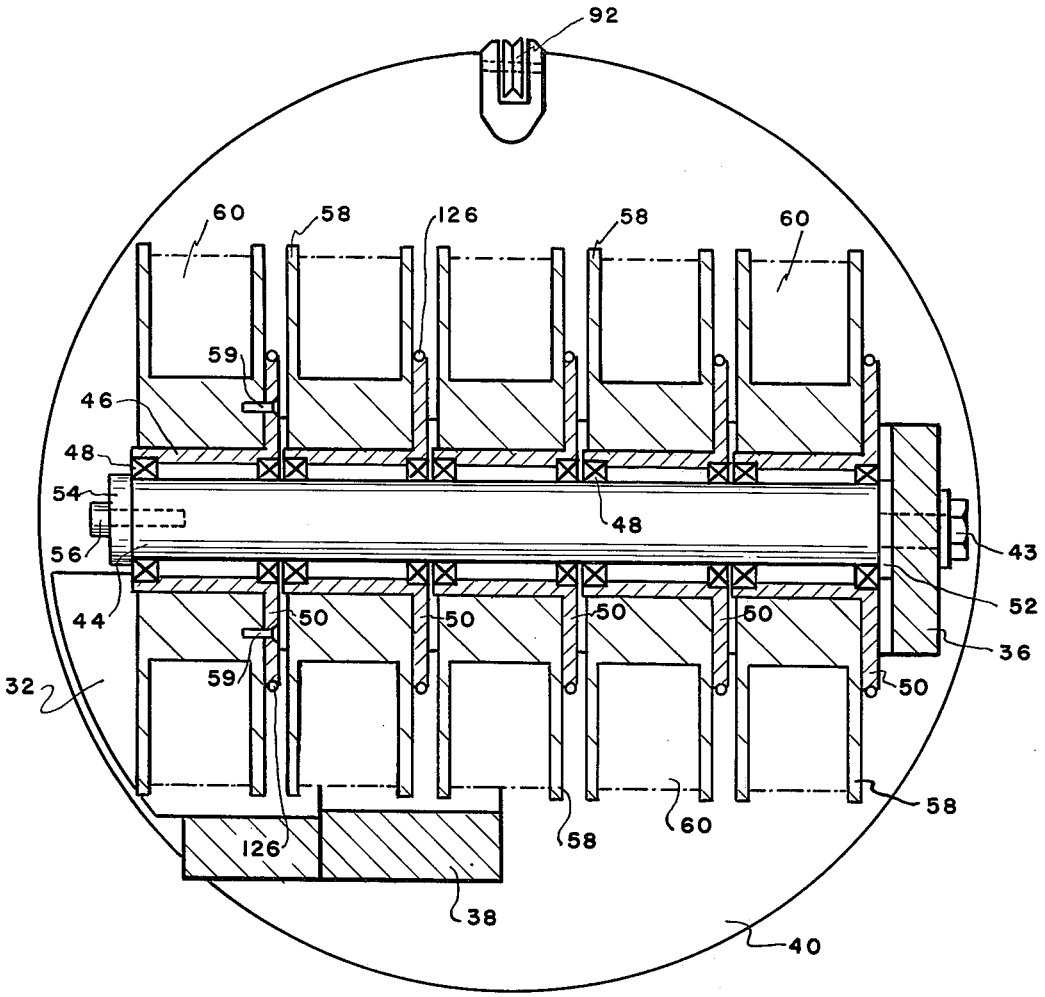
FIG. 4 is a sectional view taken on lines 4—4 of FIG. 2, certain elements being omitted for clarity.

As best shown in FIGS. 1, 2 and 4, to the back of the frame 30 on its member 36 there is mounted by virtue of a bolt 43 a stationary horizontally extending, cantileverly arranged shaft 44 on which five separate sleeves 46 are mounted, each of which is rotatably supported on the shaft 44 by pairs of space bearings 48. On each of their right ends of the sleeves 46, as one views FIG. 4, they are provided integral therewith with pully members 50. The sleeves 46 are held on the shaft 44 at one end by a collar 52 formed on the shaft and a replaceable end plate 54 which is secured to the shaft by a bolt 56. Each sleeve 46 receives an identical spool 58 rotatable therein; FIG. 4 illustrating each spool with a full winding of wire 60 while in FIG. 1 the spools are empty. The spools 58 are fastened to the sleeves 46 by the screws 59.

Figure 3:
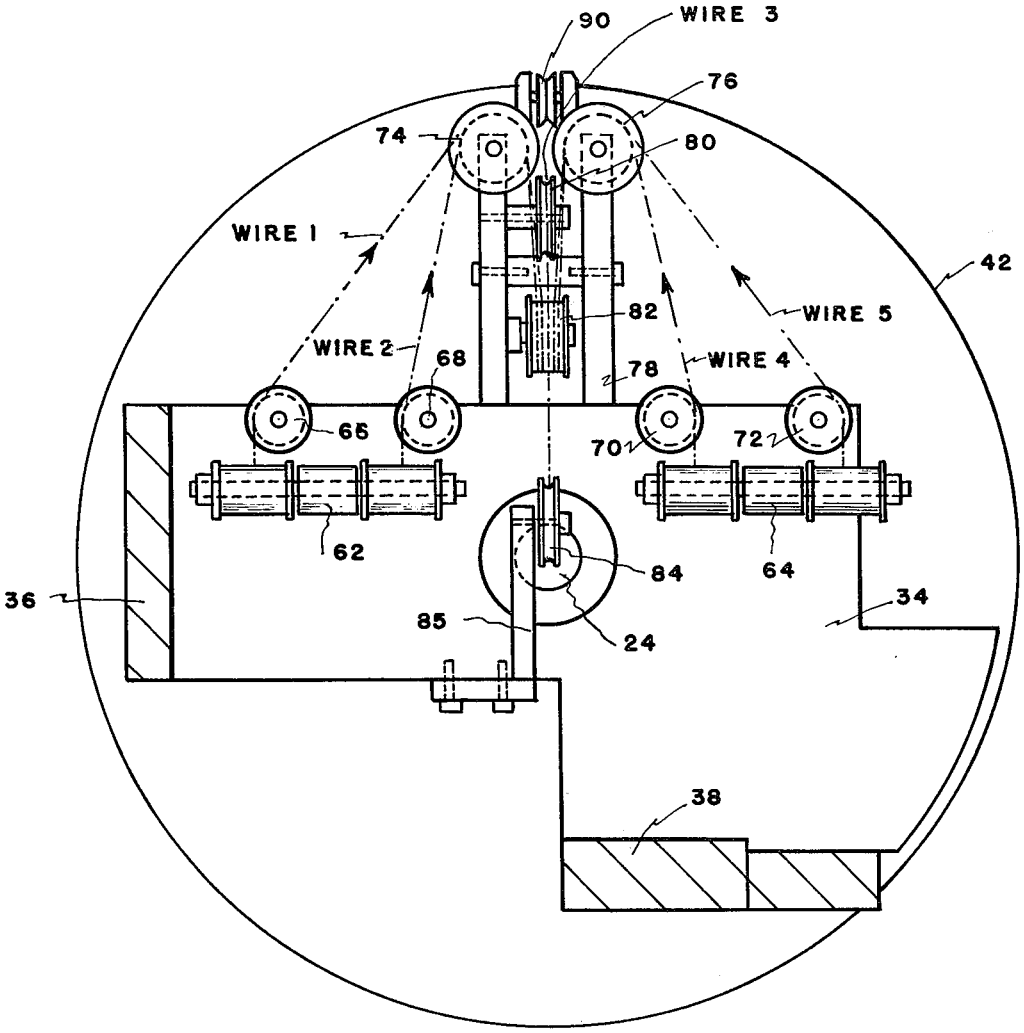
FIG. 3 is a sectional view taken on lines 3—3 of FIG. 2.

The five wires from the spools 58 are fed to a network of sheaves in order that they can be brought to a common point prior to the formation of the wire cord. FIGS. 2 and 3 best illustrate the network. Mounted on the side member 34 of the frame 30, as is best seen in FIG. 3, are two aligned sheave assemblies 62 and 64, each having spaced sheaves for guiding wire fed to them from the four outer spools 58 shown in FIGS. 1 and 4. From each sheave of the sheave assemblies 62 and 64 the individual four wires pass around sheaves 66, 68, 70 and 72 where the two wires on each side are fed to a common sheave 74 and 76. The sheaves 66–72 are rotatably mounted on the side member 34 while the sheaves 74 and 76 are rotatably supported by an upright member 78 carried by the member 34.

While referring to the upright member 78, as shown in FIG. 3, it also rotatably supports a sheave 80 which receives the fifth or center wire of the center spool 58. Immediately below the sheave 80 is a sheave 82 that receives the five wires from above; this sheave also being supported on the upright 78. The five collected vertically, downwardly running wires are next fed to a sheave 84 from where the wires are turned from a vertical to horizontal path of travel. The sheave 84, as shown in FIG. 3, is rotatably mounted on an upright 85 which is secured to the side member 34, and is arranged so that its lower surface is tangential to the center line of the shaft 24, and, more particularly, to the center of a horizontal bore 86 provided in the inner end of the shaft. As best shown in FIG. 2, at the inner end of the bore 86, there is located a sheave 88 that directs the five wires from the horizontal to the vertical as indicated by the broken arrowed line representing the wires in FIG. 2. The sheave 88 is mounted for rotation with the shaft 24 and imparts to the wires their first twist.

The twisted wires are then fed vertically to a flying sheave 90 rotatably mounted on the outer periphery of the disc 42 which, as noted before, rotates with the shaft 24. A similar flying sheave 92 is mounted on the outer periphery of the disc 40 from the twisted wire is fed inwardly to a bore 96 and a sheave 98 which rotates with the shaft 22 and through the interior of the shaft 22 where it will be wound up on a takeup spool, not shown. As the wire passes around the sheave 98 it will be given its second twist to complete the forming of the wires into the desired cord.

Figure 5:
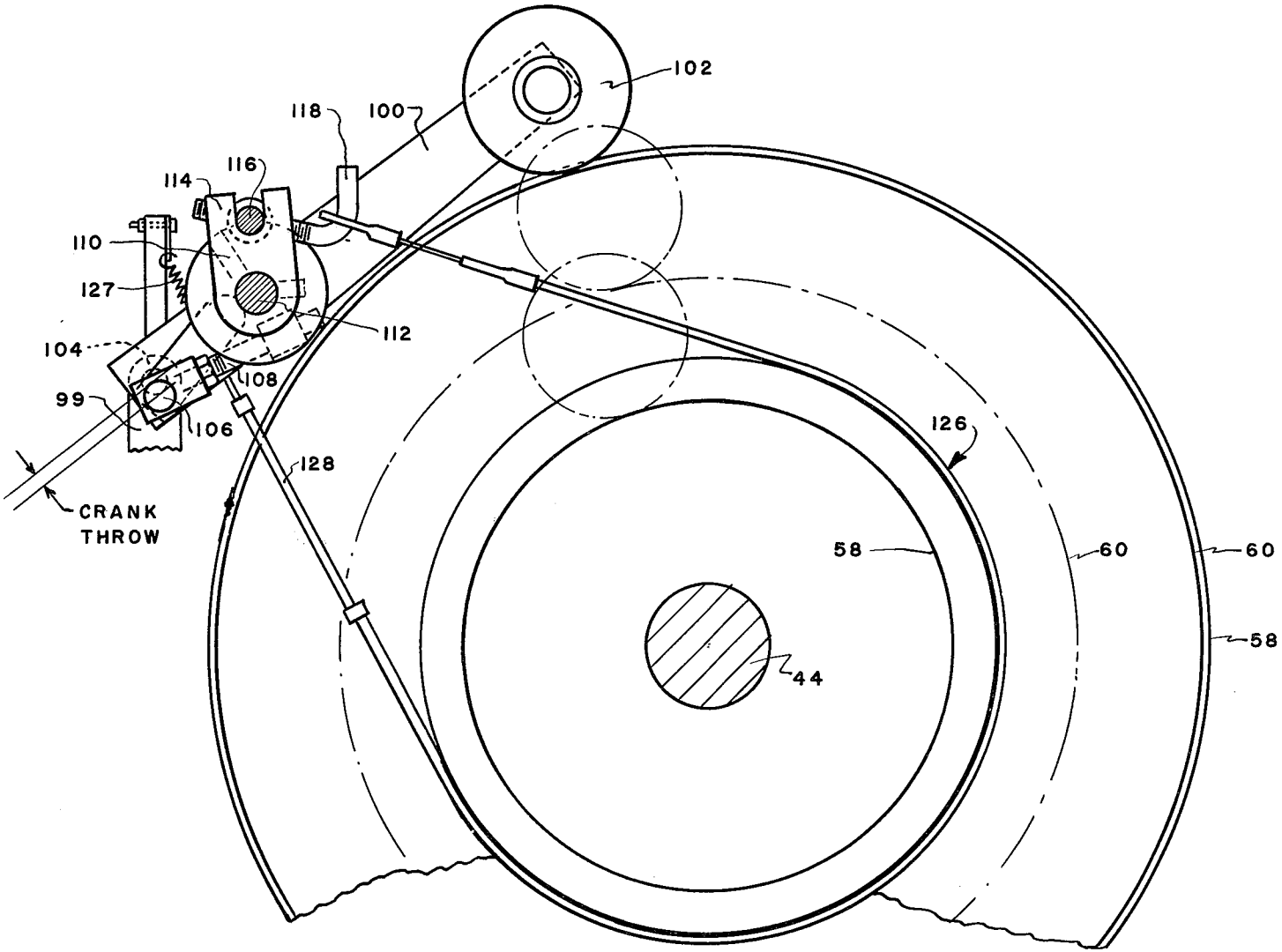
FIG. 5 is a sectional view taken on lines 5—5 of FIG. 7.
Figure 6:
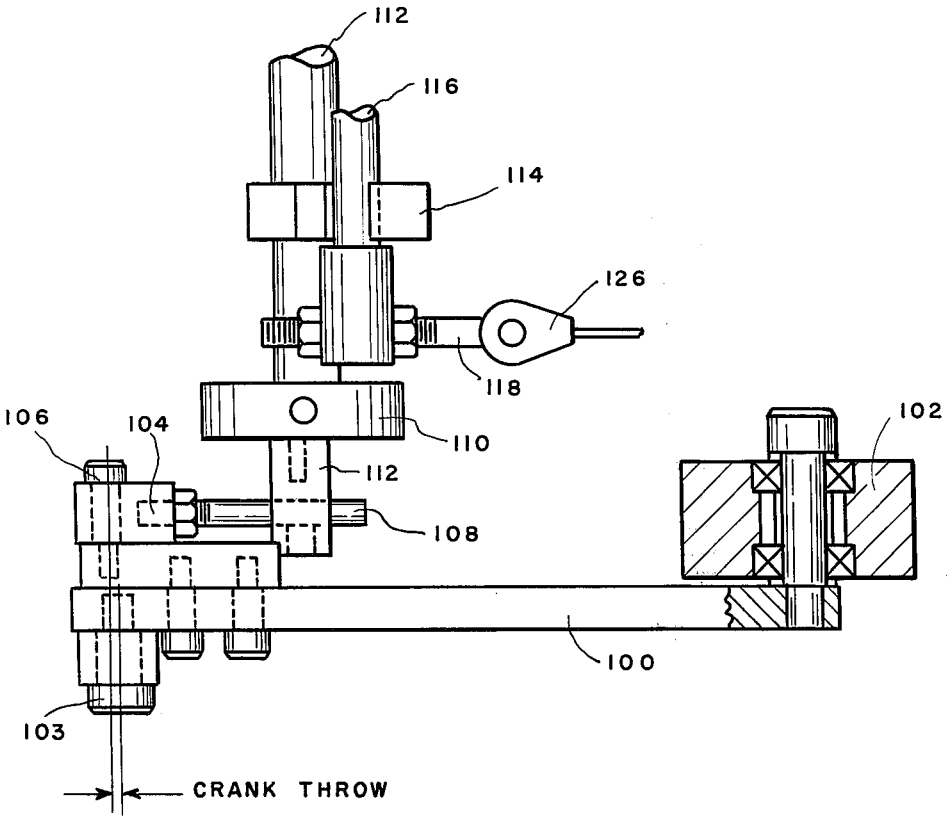
FIG. 6 is an end view, partly in section, of the wire tension control assembly shown in FIG. 5.

Turning now to the tension control system provided for the spools 58, reference is made to FIGS. 1, 2, 5, 6, and 7. On the front end of the side member 32 of the frame 30 there is pivoted to the two spaced brackets 99 a tension control arm 100 which normally extends in a generally horizontal direction towards the adjacent spool 58, which in this case is the outermost one as one views FIG. 1. To the other end of the arm 100 there is rotatably carried a roller 102 arranged to contact the outer periphery of the spool of wire 60, as best shown in FIG. 5. In this Figure, the roller is shown in full line in the position it assumes when the wire spool is full and in phantom, in two other positions. FIGS. 5 and 6 illustrate that the arm 100 at its back rotates about a pivot pin 103. The arm is also secured to an adjustable crank 104 that rotates a crank pin 106, the crank throw being identified by legends in FIGS. 5 and 6. A connecting rod 108 is secured to the crank pin which rotates a disc 110 which, in turn, is set screwed to a shaft 112 that carries a yoke 114 and which rotates with the shaft. The yoke carries, in turn, a shaft 116 which is caused to rotate by the yoke. Arranged to pass through the shaft 116 are five hooks 118 having free ends for receiving leather brake bands 126. Bands 126, as best shown in FIG. 2, are caused to encircle the adjacent spool so that their opposite ends are secured indirectly to the side member 32, as best shown in FIGS. 1 and 2. The ends of each of the brake bands terminate into a combined link and spring fastener 128, the opening being shown at 127 in FIG. 5 which, in turn, is secured to an horizontal bar 129 carried by two upright stands 130 fastened to the side member 32, as shown best in FIG. 7.

Figure 7:
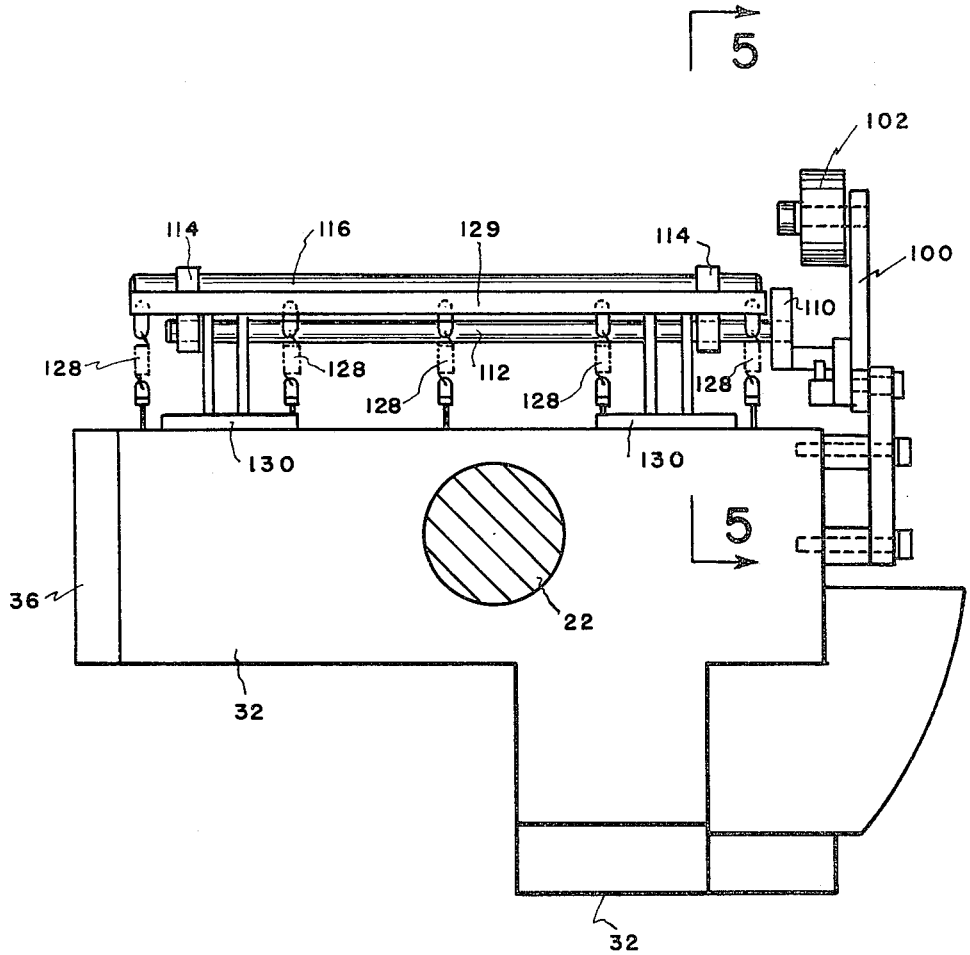
FIG. 7 is a sectional view taken on lines 7—7 of FIG. 2.

As shown in FIG. 7, there are actually provided two yokes 114 secured to the shaft 112 which shaft extends the full distance of the assembly as does the shaft 116. FIG. 7 also indicates the use of an individual brake band for each of the five spools 58.

A brief description of the operation of the above machine will now be given. Assume that the five new spools 58 have been mounted on the shaft 44 and the nut 56 tightened, the tension roller 102, which is readily swingable out of the way during the mounting of the spools, which is the position shown in FIG. 7, can be lowered to engage the wire of the first spool as shown in FIG. 1. After the spools 58 are mounted and the roller positioned, the brake bands 126 for each spool are passed around the sleeves 50 between the hooks 118 and the fasteners 128. The tension of the belt bands 126 can be adjusted by a common nut assembly provided for each of the hooks 118 so that the tension can be measured by a portable tension gauge and set at a desired value so that each spool will have the same initial tension. As the shaft 112 is caused to rotate by the lowering of the tension control roller 102, the yokes 114 will rotate to move the hooks 118 and the brake bands 126 to progressively and continually adjust the tension of the spools as a function of the reduction in the diameter of the wire 60 of the spools 58. Accordingly, the tension of the wire being unwound from the spools will be maintained constant throughout the unwinding operation. The need of tension control is based on the fact that there is a change in the leverage effect defined by the radii change between the diameter of the wire and the diameter of the brake bands at the sleeves 50. In the case of the full spool the leverage effect is the maximum and hence the radii difference in the maximum, whereas in the case of the empty or nearly empty spool, it is at the minimum. The brake bands are employed to continuously decrease the tensions on the spools to compensate for the decrease in the leverage.

The particular course that each of the five wires takes during their unwinding until they are delivered to the sheaves 84 and 88 has already been explained. The number of twists per unit length of the five wires; it being noted before that the wire is given two twists as it passes through the machine, will be a function of the speed of travel of the wire and the revolutions per minute of the discs 40 and 42; each of which imparts one twist to the wire per revolution. The speed of travel of the wire is created and controlled by a pullout capstan, not shown, that receives the wire from the opening 96 in the shaft 22 and while the discs 40 and 42 are driven by a single variable speed electrical motor and interconnected drive arrangement, not shown, provided for the shafts 22 and 24. The actual extent of wire tension and twist per unit length may follow present practice by the type of wire being used and the specific intended application of the cord.

In accordance with the provisions of the patent statutes, I have explained the principle and operation of my invention and have illustrated and described what I consider to represent the best embodiment thereof.

I claim:

1. A means of forming wire cord and similar articles of manufacture, comprising:

support means, (44) for supporting at least two spools of individual wire strands a gathering station including gathering means, flyer means, rotating means for supporting said flyer means arranged with respect to the axis of said support means (44) radially outward therefrom and from said gathering means, means for supporting said rotating means in a manner that said rotating means rotates relative to said support means (44) and said gathering means, said means for supporting said rotating means including means arranged to support to said rotating means about an axis arranged parallel to the axis of the gathered strands in said gathering station, power means for rotating said rotating means, said flyer means being arranged so that said strands are fed from said gathering means to said flyer means and then to a discharge station arranged on the same side of a means adapted to pull the wire under tension through the machine at a given rate of speed, the construction and arrangement of elements being such that the individual strands of wire are caused to be formed into a wire cord in which the number of twists per unit length thereof is a function of said speed of travel of the wire and the revolutions per minute of the rotating means.

2. A means of forming wire cord and similar articles of manufacture according to claim 1 wherein said flyer means comprises two spaced-apart flyer elements arranged radially equidistant of said axis of said rotating means.

3. A means of forming wire cord and similar articles of manufacture according to claim 2 wherein one of said flyer elements is arranged more adjacent to said gathering means than the other flyer element.

4. A means for forming wire cord and similar articles of manufacture according to claim 1 wherein said rotating means includes two discs arranged on either side of said support means (44), said flyer means includes two spaced-apart flyer elements arranged radially outward and equidistant from the axis of rotation of said rotating means and on a different one of said discs, said means for supporting said rotating means includes separate opposed shafts spaced from each other sufficient to allow the mounting of said spools on said support means (44), and wherein said power means includes means for rotating said discs in unison.

5. A means for forming wire cord and similar articles of manufacture according to claim 4 wherein said gathering means is arranged adjacent one of said flyer elements and includes for at least one of said spools a series of sheaves constructed and arranged to receive a strand of wire from an off-center position relative to a plane containing said flyer elements and to reposition said strand of wire in said plane, means for mounting one of said sheaves so as to guide all of the strands of wire from said spools to a discharge sheave mounted internally in an adjacent one of said shafts, an additional sheave mounted internally in said other shaft for receiving the wire after it has been formed into a cord, and said shafts both having openings to allow the entry and delivery of said wire relative thereto.

6. A means for forming wire cord and similar articles of manufacture according to claim 1 including means for freely mounting said spools on said arbor means (44) for relative rotational movement, means associated with at least one of said spools for engaging the wire thereof while in coil form and while it is being unwound in a manner that it is sensitive to the decrease in the diameter of said strand during its unwinding, and means connected to said sensitive means for varying the resistance to rotation of said spools as a function of their decreasing diameter thereby to maintain the tension of an individual strand of wire substantially constant during its unwinding.

7. A means for forming wire cord and similar articles of manufacture according to claim 6 wherein said sensitive means comprises:

an arm, a roller mounted on the one end of said arm, means for pivotally supporting said arm so that said roller will contact the outer periphery of the wire of one of said spools during the unwinding of its strand of wire, said means for varying the resistance of rotation includes individual friction generating means for each spool, and means for connecting said arm to said friction generating means in a manner that the friction generated will decreased as the diameter of the strands of wire decreases and the respective tensions of the individual strands of wire will be maintained substantially constant during their unwinding.

8. A means for forming wire cord and similar articles of manufacture according to claim 7 wherein said friction generating means includes individual braking straps for each spool, said connecting means including a shaft, means for connecting said arm to said shaft, and a crank arm for connecting said straps to said shaft.

9. A means for forming wire cord and similar articles of manufacture according to claim 7 wherein said connecting means includes a yieldable means adapted to urge said roller against said one spool.

10. A means for forming wire cord and similar articles of manufacture according to claim 1 wherein said discharge station is arranged coaxially with said gathering means.

11. A method of forming wire cord and similar articles of manufacture comprising the steps of:

mounting at least two spools of individual wire strands on a support means (44), unwinding said strands and feeding them into a gathering means, rotating a flyer means arranged radially outward of said gathering means in a manner that said flyer means rotates relative to said support means (44) and said gathering means, supporting said flyer means about an axis arranged parallel to the axis of the gathered strands in said gathering means, causing said strands to be fed radially outward from said gathering means to said flyer means and then to a discharge station arranged on the same side of a wire coiling means, and causing said wire coiling means to pull the strands of wire under tension over said flyer means from said spools at a given rate of speed, whereby the individual strands of wire are caused to be formed into a wire cord in which the number of twists per unit length thereof is a function of said speed of travel of the wire and the revolutions per minute of said flyer means about said coplanar axis.

12. A method of forming wire coil and similar articles of manufacture according to claim 11 the additional step of rotating said flyer means about an axis arranged perpendicular to a plane containing the axis of said support means (44).

13. A method of forming wire cord and similar articles of manufacture according to claim 12 wherein said flyer means comprises two spaced-apart flyer elements arranged radially outward and equidistant from the axis of rotation of said rotating means.

14. A method of forming wire cord and similar articles of manufacture according to claim 13 wherein one of said flyer elements is arranged more adjacent to said gathering means than the other flyer element and including the additional step of feeding said strands first to said most adjacent flyer element.

* * * * *

UNITED STATES PATENT AND TRADEMARK OFFICE

CERTIFICATE OF CORRECTION

PATENT NO. : 3 949 543

DATED : April 13, 1976

INVENTOR(S) : Jesse Clarence Bittman

It is certified that error appears in the above-identified patent and that said Letters Patent are hereby corrected as shown below:

Column 5, line 32, before "said rotating means" the word "to" should be deleted.

Column 6, line 48, the word "decreased" should read--decrease--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*